US009333758B2

(12) United States Patent
Koshikawa et al.

(10) Patent No.: US 9,333,758 B2
(45) Date of Patent: May 10, 2016

(54) LIQUID STORAGE CONTAINER AND LIQUID EJECTION APPARATUS

(71) Applicant: CANON KABUSHIKI KAISHA, Tokyo (JP)

(72) Inventors: Hiroshi Koshikawa, Yokohama (JP); Yasuo Kotaki, Yokohama (JP); Kenta Udagawa, Tokyo (JP); Naozumi Nabeshima, Tokyo (JP); Soji Kondo, Yokohama (JP); Masafumi Seki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/744,926

(22) Filed: Jun. 19, 2015

(65) Prior Publication Data

US 2015/0375514 A1 Dec. 31, 2015

(30) Foreign Application Priority Data

Jun. 27, 2014 (JP) ..... 2014-132854

(51) Int. Cl.
*B41J 2/175* (2006.01)

(52) U.S. Cl.
CPC ..... *B41J 2/17523* (2013.01)

(58) Field of Classification Search
CPC .. B41J 2/17513; B41J 2/17553; B41J 2/1752; B41J 2/17523; B41J 2/17556
USPC ..... 347/86, 84, 85
See application file for complete search history.

(56) References Cited

U.S. PATENT DOCUMENTS

| | | | | |
|---|---|---|---|---|
| 5,583,549 | A | 12/1996 | Ujita et al. | 347/86 |
| 5,619,237 | A | 4/1997 | Inoue et al. | 347/86 |
| 5,988,804 | A | 11/1999 | Kotaki et al. | 347/87 |
| 6,145,972 | A | 11/2000 | Udagawa et al. | 347/86 |
| 6,338,546 | B1 | 1/2002 | Kotaki et al. | 347/49 |
| 6,419,350 | B1 | 7/2002 | Abe et al. | 347/86 |
| 7,434,921 | B2 | 10/2008 | Udagawa | 347/85 |
| 7,703,903 | B2 | 4/2010 | Tsai et al. | 347/86 |
| 8,087,762 | B2 | 1/2012 | Takemura et al. | 347/85 |
| 8,205,974 | B2 | 6/2012 | Ogura et al. | 347/86 |

(Continued)

FOREIGN PATENT DOCUMENTS

JP 2011-206936 10/2011

OTHER PUBLICATIONS

U.S. Appl. No. 14/744,939, filed Jun. 19, 2015.
U.S. Appl. No. 14/744,973, filed Jun. 19, 2015.

*Primary Examiner* — Manish S Shah
*Assistant Examiner* — Yaovi Ameh
(74) *Attorney, Agent, or Firm* — Fitzpatrick, Cella, Harper & Scinto

(57) ABSTRACT

There is provided a liquid storage container capable of keeping a negative pressure therein more reliably. An ink cartridge includes a negative pressure generation unit configured to generate a negative pressure in an ink storage chamber and a filter attached to an atmosphere communication channel opening and allowing air to pass from the outside to the inside of the liquid storage chamber depending on the negative pressure in the ink storage chamber. The ink cartridge has a capillary groove configured to supply ink from a portion in which ink is stored in the ink storage chamber to the filter.

15 Claims, 9 Drawing Sheets

(56) References Cited

U.S. PATENT DOCUMENTS

| | | | | |
|---|---|---|---|---|
| 8,529,037 | B2 | 9/2013 | Miyashita et al. | 347/86 |
| 8,770,730 | B2 | 7/2014 | Nanjo et al. | 347/86 |
| 8,960,869 | B2 | 2/2015 | Takada et al. | 347/86 |
| 2002/0012033 | A1* | 1/2002 | Iwanaga | B41J 2/17503 347/86 |
| 2003/0122909 | A1* | 7/2003 | Ogura | B41J 2/17506 347/86 |
| 2011/0234719 | A1 | 9/2011 | Mizutani et al. | 347/86 |

* cited by examiner

LIQUID STORAGE CONTAINER AND LIQUID EJECTION APPARATUS

BACKGROUND OF THE INVENTION

1. Field of the Invention

The present invention relates to a liquid storage container for storing liquid in a liquid storage chamber and a liquid ejection apparatus having the liquid storage container mounted thereon and, in particular, to a liquid storage container and a liquid ejection apparatus in which air is filled into a liquid storage chamber if a negative pressure in the liquid storage chamber exceeds a predetermined level.

2. Description of the Related Art

Some ink jet printing apparatuses have an ink storage container mounted on a carriage and supply ink stored in the ink storage container into a print head. In some ink storage containers, a negative pressure is formed inside the ink storage container to avoid leakage of ink supplied to the print head from ejection ports.

In some of the ink storage containers in which a negative pressure is formed, for example, a bag member formed by a flexible film is provided inside, and the inside or the outside of the bag member is provided with a spring or the like that urges the film in a direction in which a volume of the bag member expands. In the ink storage container having the above configuration for keeping the inside of the bag member to be a negative pressure, as the ink in the ink storage container is consumed, an absolute value of the negative pressure in the bag member gradually increases.

In general, a negative pressure is expressed as a minus value, whereas a capillary force is expressed as a plus value. To simply express a balance between the negative pressure and the capillary force, no distinction is made between a positive value and a negative value, and the term "absolute value" is used in the present specification.

Japanese Patent Laid-Open No. 2011-206936 and U.S. Pat. No. 7,703,903 disclose an ink storage container provided with a filter which allows air to be supplied to a bag member if a negative pressure in the bag member exceeds a predetermined level, so as to keep the negative pressure inside the bag member at a predetermined level in the ink storage container. Since air is introduced from the outside to the inside of the bag member through the filter if the negative pressure in the bag member exceeds a predetermined level, the negative pressure in the bag member will not increase excessively, allowing the negative pressure in the bag member to be kept at the predetermined level.

It is required that the filter which allows air to be supplied to the bag member if the negative pressure in the bag member exceeds a predetermined level be immersed in a liquid.

SUMMARY OF THE INVENTION

In a first aspect of the present invention, there is provided a liquid storage container comprising: a liquid storage chamber storing therein a liquid; a communication portion formed in the liquid storage chamber and allowing the liquid storage chamber to communicate with the outside; a negative pressure generation unit configured to generate a negative pressure in the liquid storage chamber; a limiting member attached to the communication portion and allowing air to pass from the outside to the inside of the liquid storage chamber depending on the negative pressure in the liquid storage chamber; and a liquid supply unit configured to supply a liquid to the limiting member from a portion in which the liquid is stored in the liquid storage chamber.

Further features of the present invention will become apparent from the following description of exemplary embodiments (with reference to the attached drawings).

DESCRIPTION OF THE EMBODIMENTS

With the ink storage container disclosed in Japanese Patent Laid-Open No. 2011-206936 and U.S. Pat. No. 7,703,903, there may be a case where a liquid does not exist around a filter. If the ink storage container is disposed under such a condition, air is likely to remain inside the filter.

If the air exists inside the filter, a meniscus will not be maintained inside the filter, and air outside the ink storage container may come into the ink storage container. This prevents the negative pressure in the ink storage container from being kept, and the ink may not be maintained further in the print head or in the ink storage container.

In view of the above circumstances, an object of the present invention is to provide a liquid storage container capable of keeping the negative pressure inside the liquid storage container more reliably.

Embodiments of the ink cartridge according to the present invention will now be described with reference to the attached drawings. It should be noted that the following embodiments are examples of preferred embodiments for carrying out the present invention, and the present invention should not be limited to these configurations.

First Embodiment

Configuration of Ink Jet Printing Apparatus

Figure 1:
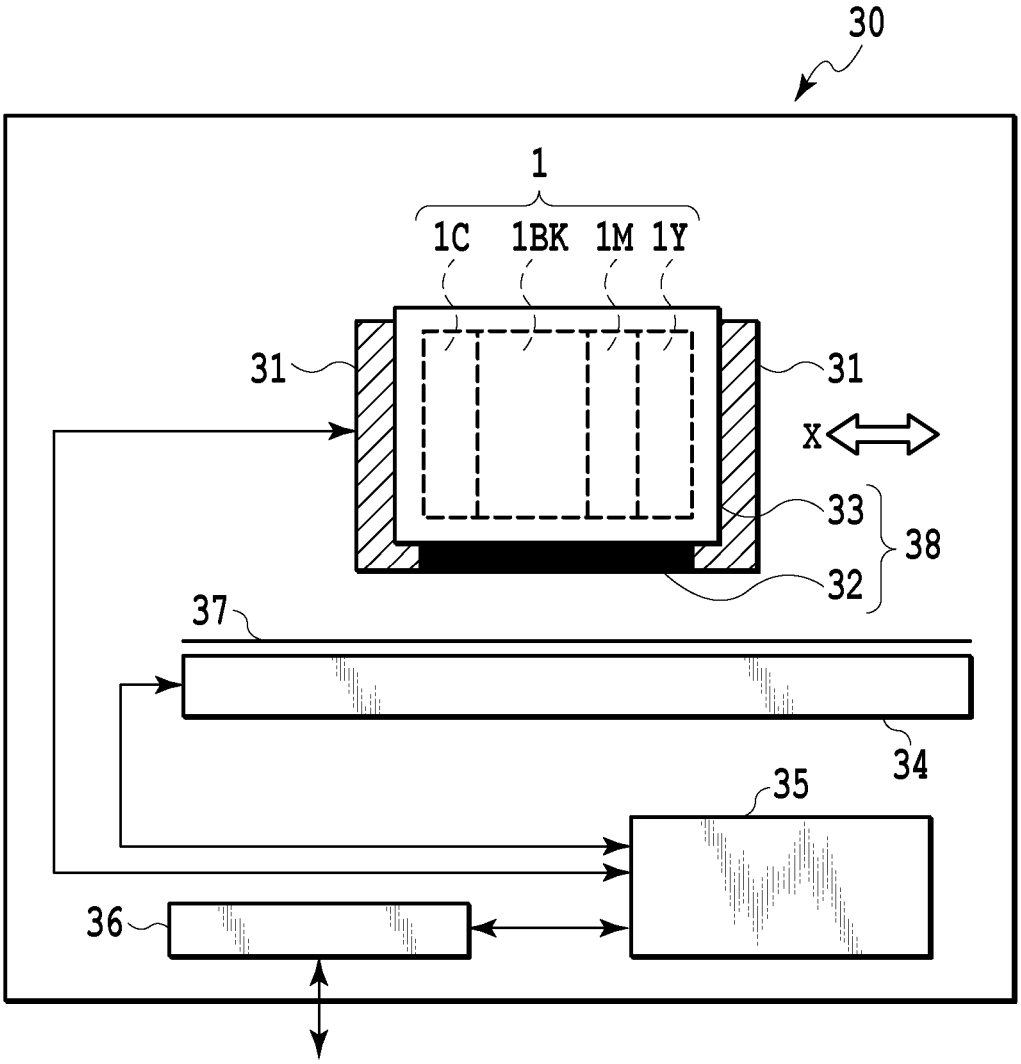
FIG. 1 is a cross-sectional view schematically showing a general configuration of an ink jet printing apparatus on which an ink cartridge is mounted according to a first embodiment of the present invention.

FIG. 1 is a cross-sectional view schematically showing a general configuration of an ink jet printing apparatus (liquid ejection apparatus) on which an ink cartridge 1 is mounted according to a first embodiment of the present invention.

A printing apparatus body 30 includes a carriage 31, a print head 32, a mounting portion 33, a conveying unit 34, and a control unit 35. In addition, the printing apparatus body 30 includes an input/output unit 36, an outer cover that can be open or closed (not shown), a feeding unit, a feeding cassette, a discharge tray, an operation unit, and the like. The ink cartridge 1 as an ink storage container (liquid storage container) is mounted on the carriage 31 in the ink jet printing apparatus body (hereinafter also referred to as the "apparatus body") 30. The printing apparatus body 30 may be connected to external devices (not shown) such as a computer, a digital camera, a memory card, and the like via the input/output unit 36.

The control unit 35 controls the entire printing apparatus body 30, controls information communications with the ink cartridge 1, analyzes and processes information received from the external devices via the input/output unit 36, outputs information to the input/output unit 36, and the like. For example, the control unit 35 provides instructions for operating devices such as the carriage 31, the print head 32, the conveying unit 34, and the feeding unit and controls the operations of the devices. The control unit 35 also performs control to read information unique to a cartridge such as an ink color, an initial amount of ink filled, and an ink consumption from a memory element provided for the ink cartridge 1 and control to write the information such as the ink consumption into the memory element provided for the ink cartridge 1. Furthermore, the control unit 35 analyzes and processes information such as printing instructions and image data received from the external devices via the input/output unit 36 and outputs information such as a remaining amount of ink to the input/output unit 36.

The carriage 31 is provided with a mounting portion 33 (hereinafter also referred to as a "cartridge mounting unit" or a "holder") on which the print head 32 and the ink cartridge 1 are removably mounted. In the present embodiment, a head unit (hereinafter also referred to as a "cartridge mounting unit") 38 in which the print head 32 and the mounting portion 33 are integrated is configured to be removably mounted on the carriage 31. The carriage 31 is movable in an X axis direction crossing a direction in which a print medium 37 is conveyed.

The mounting portion 33 provided for the carriage 31 is configured such that ink cartridges 1C, 1Bk, 1M, and 1Y for respectively storing therein inks (liquids) of cyan (C), black (Bk), magenta (M), and yellow (Y) can be removably mounted. The ink cartridge 1Bk has a greater width and a larger capacity as compared to the other three ink cartridges 1C, 1M, and 1Y. Further, the print head 32 has color head units for individually ejecting inks of cyan (C), black (Bk), magenta (M), and yellow (Y). Each color of ink supplied from the ink cartridge 1 can be ejected from each color head unit.

The print head 32 is provided with a plurality of ejection ports. A heat generating element is disposed for each of paths extending to the ejection ports in the print head 32. When the heat generating element is energized to generate thermal energy from the heat generating element, ink in the path is heated and bubbled by film boiling, and the resulting bubbling energy allows ink droplets to be ejected from the ejection port. It should be noted that the print head 32 of the present embodiment uses a system in which the film boiling is generated and ink is bubbled by the heat generating element to eject ink droplets. However, the present invention should not be limited to this embodiment. A print head using a system in which a piezoelectric element is deformed so as to eject a liquid in the print head may be applied to the printing apparatus, or other print head using other system may be applied to the present invention.

To remove, mount, or replace the ink cartridge 1 with respect to the carriage 31, a user first opens the outer cover (not shown) that covers the carriage 31, the conveying unit 34, and the like. Upon detection of the open state of the outer cover by the printing apparatus body, the carriage 31 moves to a "cartridge replacement position (not shown)." The user can insert the ink cartridge 1 into the carriage 31 in the cartridge replacement position or remove the ink cartridge 1 from the carriage 31 in the cartridge replacement position.

If the user closes the outer cover after removing, mounting, or replacing the ink cartridge 1, the closed state of the outer cover is detected. Upon detection of the closed state, the control unit 35 of the printing device body 30 reads ink color information from the memory element of the ink cartridge mounted on the carriage 31. The control unit 35 determines whether all of the colors (four colors in the present embodiment) of the ink cartridges which should be mounted on the carriage 31 are mounted based on the read ink color information. If it is determined that there is a color of the ink cartridge that is not mounted on the carriage 31, the control unit 35 sends an error display command to the operation unit or the external device to display an error message on a display panel of the operation unit or a display unit of the external device. Meanwhile, if it is determined that all of the colors of the ink cartridges are mounted on the carriage 31, the ink jet printing apparatus becomes a printable condition.

If a printing instruction is input from the external device or the operation unit to the control unit 35, the control unit 35 determines whether the printing apparatus is under a printable condition. If it is under a printable condition, the feeding unit (not shown) picks a print medium 37 loaded into the feeding cassette (not shown) and feeds the picked print medium 37 toward the conveying unit 34. The conveying unit 34 includes a platen for supporting the under surface of the print medium 37, a conveying roller that can intermittently convey the print medium 37, a driving unit for rotary driving the conveying roller, and the like. The conveying unit 34 conveys the print medium 37 fed by the feeding unit to the discharge tray (not shown). Between one conveying operation and the following conveying operation of the print medium 37, the carriage 31 moves in an X direction crossing a direction in which the print medium 37 is conveyed. Ink is ejected from the print head 32 to the print medium 37 during movement of the carriage 31, whereby an image is formed on the print medium 37. Accordingly, repeating the movement of the carriage 31 along with the conveyance of the print medium 37 can form an image on the print medium 37.

The present embodiment employs a structure for removably mounting the head unit (cartridge mounting unit) 38 on the carriage 31. However, the present invention is not limited to this embodiment. The present invention may take a form in which the print head 32 and the mounting portion 33 are removably mounted on the carriage 31 individually. The mounting portion 33 may be integrated into the carriage 31, and only the print head 32 may be removably mounted on the carriage 31. Furthermore, both of the print head 32 and the mounting portion 33 may be integrated into the carriage 31. In short, the carriage 31 only needs to have a configuration in which the print head 32 can be mounted on the carriage 31 and the ink cartridge 1 is removably mounted on the carriage 31.

It should be noted that in the present embodiment, the ink jet printing apparatus is a printing apparatus of a so-called serial scan type for printing an image while a print head is moved in a main scanning direction and a print medium is conveyed in a sub-scanning direction. However, the present invention may also be applied to a printing apparatus of a full line type using a print head which extends across the entire width of the print medium.

(Configuration of Housing)

Figure 2:
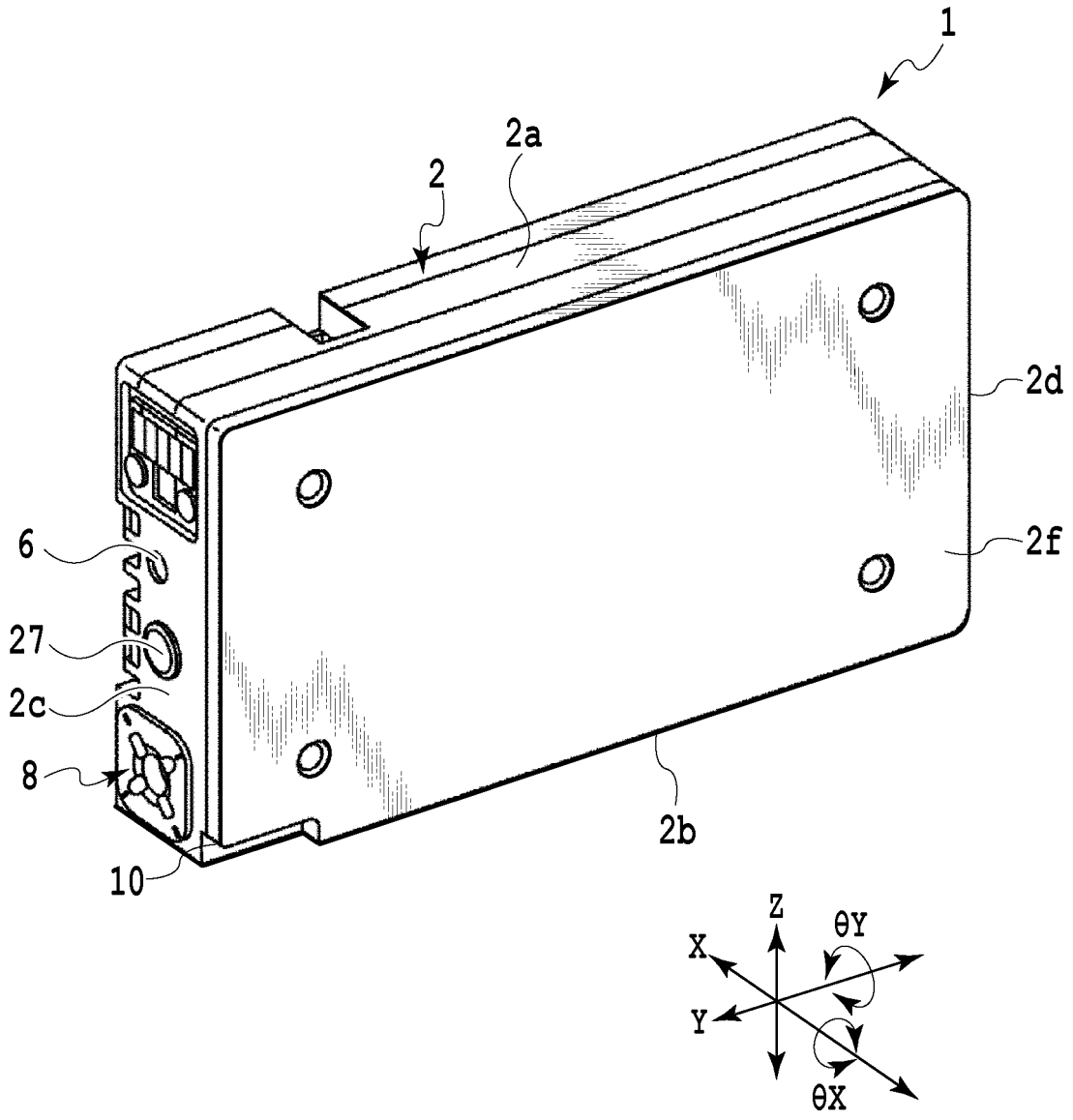
FIG. 2 is a perspective view of the ink cartridge mounted on the ink jet printing apparatus of FIG. 1.
Figure 3:
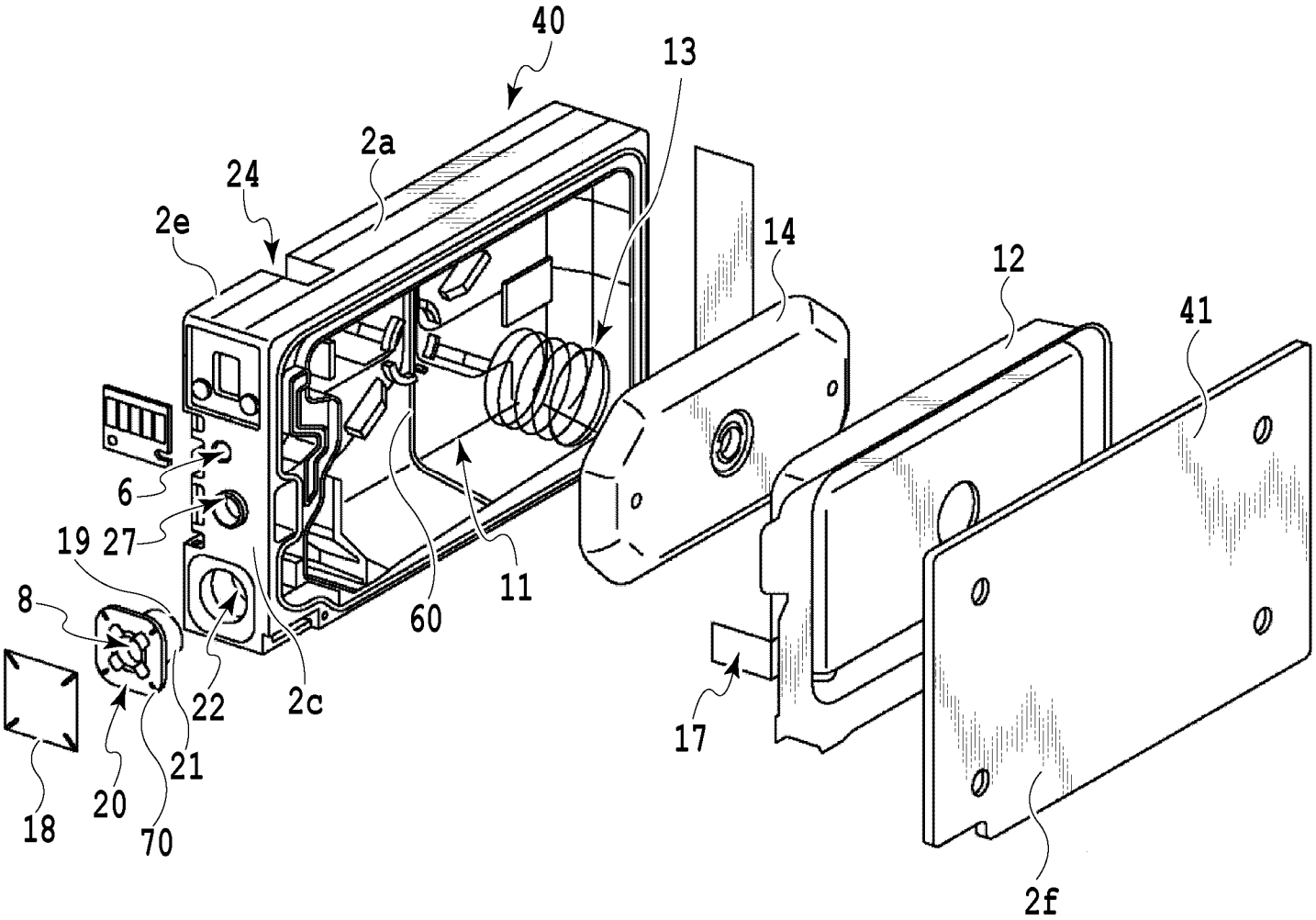
FIG. 3 is an exploded perspective view of the ink cartridge of FIG. 2.
Figure 4:
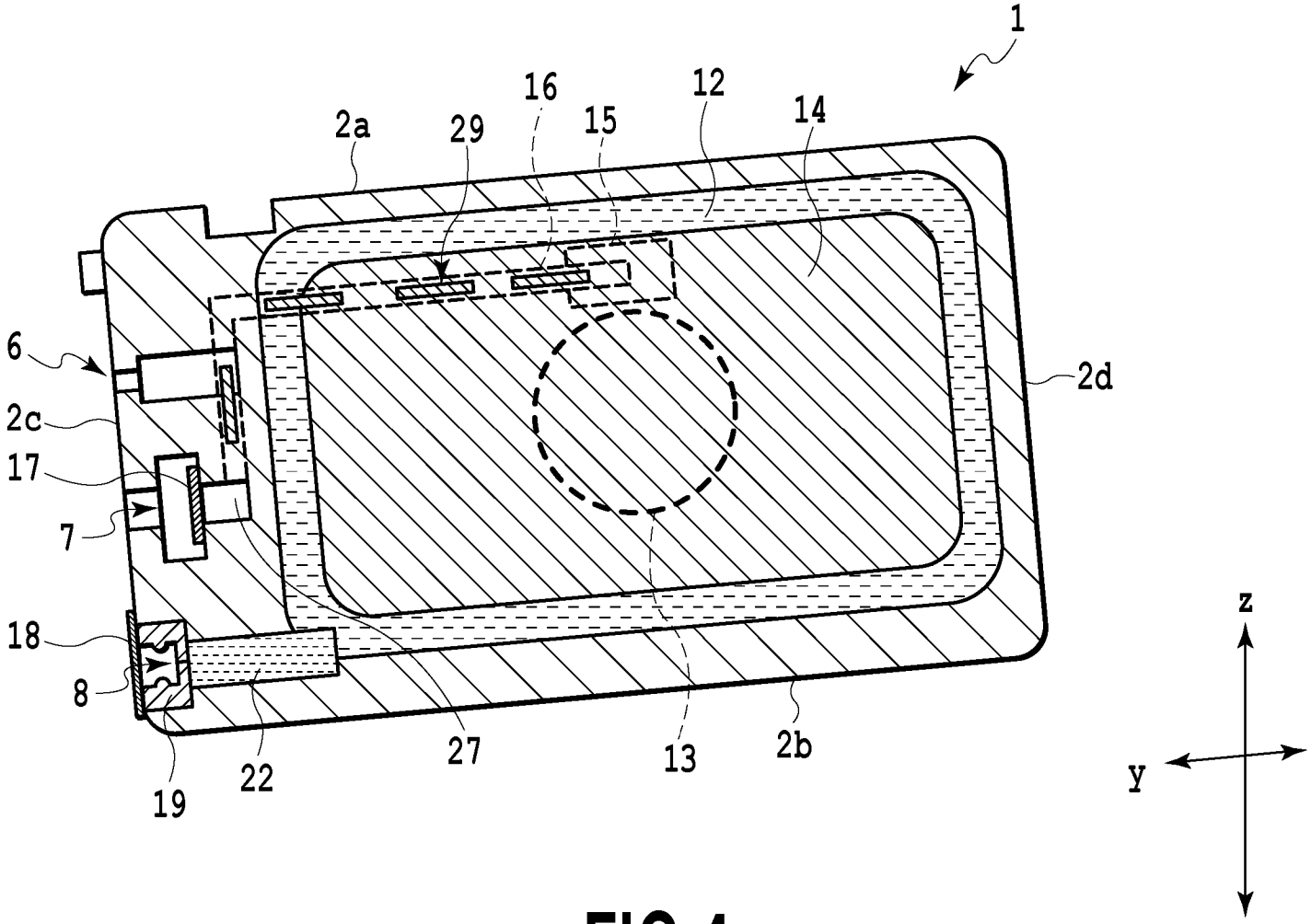
FIG. 4 is a cross-sectional view of the ink cartridge of FIG. 2.

As shown in FIGS. 2 and 3, the ink cartridge 1 as the ink storage container is provided with a housing (hereinafter also referred to as a "cartridge body" or a "container body") 2 in a rectangular shape having therein an ink storage chamber (liquid storage chamber) 11. FIG. 2 is a perspective view of the ink cartridge. FIG. 3 is an exploded perspective view of the ink cartridge of FIG. 2, showing the internal configurations. FIG. 4 is a cross-sectional view of the ink cartridge which is filled with ink.

In FIG. 2, a Y axis direction is a direction corresponding to the depth of the ink cartridge mounted on or removed from the carriage 31 and is also a mounting direction (inserting direction) and a removing direction (releasing direction) of the cartridge. The housing 2 has a first housing member 40 including a top surface 2*a*, a bottom surface 2*b*, a front surface 2*c*, a back surface 2*d*, and a left surface 2*e* and a second housing member 41 including a right surface 2*f*. The second housing member 41 serves as a cover member for covering an opening of the first housing member 40.

As shown in FIGS. 2, 3, and 4, the front surface 2*c* of the housing is provided with a positioning hole 6 as a positioning portion, a through hole 27 as a through portion, and a tube insertion port 8 as a tube insertion portion. The positioning hole 6, the through hole 27, and the tube insertion port 8 function as a cartridge interface portion connected to a printing apparatus body interface portion provided for the mounting portion 33. The positioning hole 6, the through hole 27, and the tube insertion port 8 are respectively connected to a positioning pin 53, a tear pin 51, and an ink receiving tube 52 which are included in the printing apparatus body interface portion shown in FIGS. 5A and 5B which will be described later.

The configuration of the ink cartridge will now be described with an emphasis on the cartridge interface portion.

As shown in FIGS. 2, 3, and 4, the tube insertion port 8 is provided near the bottom surface which is a lower portion (a portion closer to the bottom surface 2*b* than the top surface 2*a*) of the front surface 2*c* of the housing 2. The tube insertion port 8 is formed at one end portion of a tube insertion path 22, and the other end portion of the tube insertion path 22 is connected to the ink storage chamber 11. The tube insertion path 22 is provided with a seal member 19 made of an elastic body (for example, a ring rubber).

As shown in FIG. 4, before the ink cartridge 1 is mounted on the mounting portion 33, that is, before the ink cartridge 1 is used, a tube insertion port sealing film 18 as a sealing member is attached to a portion around the tube insertion port 8 so as to seal the tube insertion port 8. The tube insertion port sealing film 18 serves as an ink leakage prevention unit for preventing ink leakage before the use of the cartridge, such as in physical distribution. When the ink cartridge 1 is mounted, the tube insertion port sealing film 18 is unsealed by the ink receiving tube 52.

As shown in FIGS. 3 and 4, an atmosphere communication port 7 and the through hole 27 are provided between the tube insertion port 8 and the positioning hole 6 in a direction corresponding to the height of the cartridge. In other words, the atmosphere communication port 7 and the through hole 27 are disposed higher than the tube insertion port 8 and lower than the positioning hole 6. As shown in FIG. 4, an atmosphere communication channel 16 is formed between the atmosphere communication port 7 and a space inside the ink storage chamber 11.

One end portion of the apparatus body in the atmosphere communication channel 16 is the atmosphere communication port 7. The other end portion of the atmosphere communication channel 16 is connected to the ink storage chamber 11. An atmosphere communication channel opening (communication portion) 64 (FIGS. 6A and 6B) positioned at a connection between the atmosphere communication channel 16 and the ink storage chamber 11 is provided with a filter (limiting member) 15 as a porous member having a meniscus force. The filter 15 allows air to pass from the atmosphere communication channel 16 to the inside of the ink storage chamber 11 depending on a negative pressure in the ink storage chamber 11. Further, the filter 15 prevents ink or air from passing from the inside of the ink storage chamber 11 to the outside. This can suppress ink leakage from the atmosphere communication channel opening 64 and can maintain the negative pressure in the ink storage chamber 11. Further, attaching the filter 15 to the atmosphere communication channel opening 64 allows air to enter the ink storage chamber 11 when the negative pressure in the ink storage chamber 11 is high so that the ink storage chamber 11 is filled with air. The atmosphere communication channel 16 is connected to the ink storage chamber 11, and the filter 15 is attached to a connection portion between the atmosphere communication channel 16 and the ink storage chamber 11. The filter 15 is attached to the atmosphere communication channel 16 so as to cover a channel communicating with the ink storage chamber 11 in the atmosphere communication channel 16.

Ink in the ink storage chamber 11 is maintained by the meniscus force of the filter 15. Therefore, when the filter 15 is working, the filter 15 prevents the ink from leaking out to the atmosphere communication channel 16, and allows the ink to be maintained inside the ink storage chamber 11.

As the ink is consumed, the negative pressure in the ink storage chamber 11 increases, and if the negative pressure in the ink storage chamber 11 reaches or exceeds the meniscus force of the filter 15, air is supplied to the ink storage chamber 11 through the filter 15. At this time, air in the atmosphere communication channel is introduced into the ink storage chamber 11 by breaking the meniscus of the filter 15, and the ink storage chamber 11 is filled with the air.

As the negative pressure in the ink storage chamber 11 increases, air is introduced into the ink storage chamber 11 through the atmosphere communication channel 16. This can prevent the negative pressure in the ink storage chamber 11 from being excessively high. This allows the negative pressure in the ink storage chamber 11 to be kept at a predetermined level. Accordingly, it is possible to suppress effect of an imbalance between the negative pressure in the ink storage chamber 11 and the negative pressure in the print head 32 on the ink supply from the ink storage chamber 11 to the print head 32, caused by an excessively high negative pressure in the ink storage chamber 11.

Furthermore, as shown in FIGS. 3 and 6, a capillary groove (liquid supply unit) 60 is formed on wall surfaces which form the ink storage chamber 11 so as to extend radially from the atmosphere communication channel opening 64. In the present embodiment, the capillary groove 60 is formed on a surface inside the left surface 2*e* forming the first housing member 40 in the ink cartridge 1.

In the present embodiment, even if the ink stored in the ink storage chamber 11 is consumed and the negative pressure increases, air in an amount corresponding to the increase is filled into the ink storage chamber 11, and accordingly, the negative pressure between the inside of the ink storage chamber 11 and the print head 32 is kept in balance. Since the ink stored in the ink storage chamber 11 is smoothly supplied to the print head 32, the ink in the ink storage chamber 11 may be used up.

As shown in FIG. 4, before the ink cartridge 1 is mounted on the mounting portion 33, that is, before the ink cartridge 1 is used, an atmosphere communication port sealing film 17 as a sealing member is disposed to cover the atmosphere communication port 7. The atmosphere communication port sealing film 17 is folded by substantially 90 degrees with respect to a main surface of a flexible member 12 as shown in FIG. 3. The atmosphere communication port sealing film 17 is in contact with an inner wall edge of the first housing member 40 to cover the atmosphere communication port 7 provided in the first housing member 40 through a hole portion 92 provided on the first housing member 40.

When the ink cartridge 1 is mounted, the atmosphere communication port sealing film 17 is unsealed by the tear pin 51 which is inserted into the atmosphere communication port 7 through the through hole 27. It should be noted that the atmosphere communication port sealing film 17 is integrally formed with the flexible member 12 in the present embodiment, but the configuration of the atmosphere communication port sealing film 17 is not limited to this. For example, the atmosphere communication port sealing film 17 may be formed as a component separate from the flexible member 12.

The atmosphere communication port sealing film 17 serves as a unit for preventing ink evaporation and ink leakage before the use of the cartridge, such as in physical distribution. The timing at which the atmosphere communication port sealing film 17 is unsealed is preferably immediately before the use of the ink cartridge. The present embodiment, therefore, uses a configuration in which the atmosphere communication port sealing film 17 is unsealed by the tear pin 51 of the printing apparatus body, so that the atmosphere communication port sealing film 17 is unsealed at a timing at which the ink cartridge 1 is mounted on the printing apparatus body.

(Configuration of Inside of Ink Storage Chamber)

Next, an internal configuration of the ink cartridge will be described with an emphasis on the configuration of the ink storage chamber. The ink storage chamber 11 is a chamber storing ink in an internal space formed by an inner wall surface of the first housing member 40 and the flexible member 12 that is in close contact with the inner wall edge of the first housing member 40. The flexible member 12 is formed of a flexible sheet. Ink is stored inside the ink storage chamber 11.

A seal member unit 20 is attached to the tube insertion path 22. The seal member unit 20 is fitted into the tube insertion path 22 provided for the first housing member 40 so as to be attached to the tube insertion path 22. The seal member unit 20 includes the seal member 19 which is cylindrical in shape and has a slit that can be open or closed at one end and an opening at the other end and an outer cover 21 integrally formed with the outer peripheral surface of the seal member 19. If the seal member unit 20 is inserted into the tube insertion path 22, the seal member unit 20 forms the tube insertion port 8.

As shown in FIG. 3, inside the ink storage chamber 11, there are provided a negative pressure generation spring 13 as a negative pressure generation unit and a plate member 14 that is smaller than the periphery of the inner wall of the first housing member 40. Further, the ink cartridge 1 is provided with the flexible member 12 as a negative pressure generation unit so as to form a portion of the ink storage chamber 11. One end of the negative pressure generation spring 13 engages with and is fixedly attached to the inner wall of the left surface 2*e* of the first housing member 40. The other end of the negative pressure generation spring 13 fixedly engages with and is attached to the plate member 14. The negative pressure generation spring 13 maintains the negative pressure in the ink storage chamber within a predetermined range by urging the flexible member 12 in a direction in which the ink storage chamber expands via the plate member 14. As described above, the ink cartridge 1 has the flexible member 12 attached to the ink storage chamber 11 and the negative pressure generation spring 13 as an urging unit that urges in a direction in which a volume of the ink storage chamber 11 expands.

In a case where ink in the ink storage chamber 11 decreases by being supplied to the outside, the negative pressure in the ink storage chamber 11 tends to significantly increase. However, if ink in the ink storage chamber 11 decreases, the negative pressure generation spring 13 contracts accordingly and the plate member 14 moves in a direction in which the internal volume of the ink storage chamber 11 decreases, whereby a significant increase in the negative pressure can be suppressed.

(Configuration of Joint Unit)

Figure 5A:
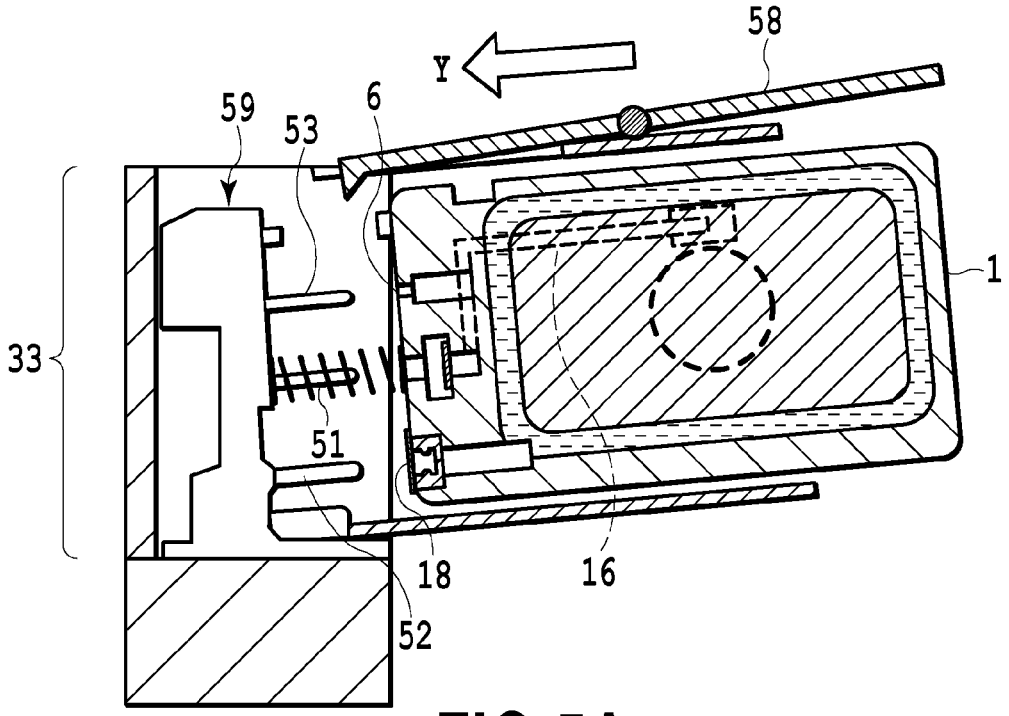
FIG. 5A is a cross-sectional view of the ink cartridge when the ink cartridge of FIG. 2 is mounted on a joint unit.
Figure 5B:
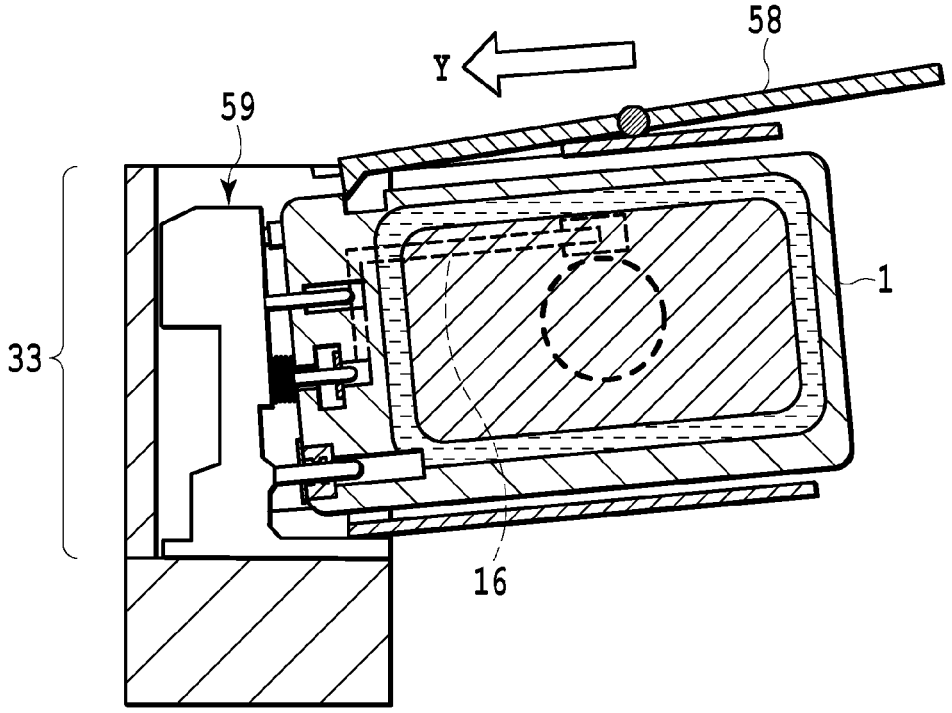
FIG. 5B is a cross-sectional view of the ink cartridge when the mounting of the ink cartridge of FIG. 2 is completed.

Next, an interface portion near the printing apparatus body will be described. As shown in FIGS. 5A and 5B, the mounting portion 33 is provided with a joint unit 59. The joint unit 59 has the tear pin 51 that is cylindrical in shape and has a pointed tip on a supporting surface that can face the front surface 2*c* of the ink cartridge, the ink receiving tube 52 that is a hollow needle being tapered and cylindrical in shape and having an opening at its tip, and the positioning pin 53 that is tapered and cylindrical in shape.

The tear pin 51 is a tear member for tearing open the atmosphere communication port sealing film 17 when the ink cartridge 1 is mounted. In the present embodiment, the tear pin 51 is first inserted into the through hole 27, and then the tear pin 51 that has penetrated the through hole 27 unseals the atmosphere communication port sealing film 17 while being inserted into the atmosphere communication port 7.

The tear pin 51 is provided with a path, which is open at a tip portion of the tear pin 51. The path formed inside the tear pin 51 is connected to a path formed inside the joint unit 59. The path formed inside the joint unit 59 extends to an atmosphere communication port (not shown) for the communication between the path and the atmosphere. In this manner, the path formed inside the tear pin 51 is connected to the path formed inside the joint unit 59, and the path and the atmosphere communicate with each other in the joint unit 59. The ink cartridge 1 is attached to the joint unit 59, and when the tear pin 51 is inserted into the atmosphere communication port 7, the path inside the tear pin 51 and the atmosphere communication channel 16 of the ink cartridge 1 are connected. Accordingly, the inside of the ink storage chamber 11 communicates with the atmosphere.

An ink receiving needle as the ink receiving tube 52 is an ink receiving member for tearing open the tube insertion port sealing film 18 and receiving ink from the tube insertion path 22 while being inserted into the tube insertion port 8 and connected to the tube insertion path 22. This ink receiving tube 52 communicates with the print head 32 and supplies ink received from the tube insertion path 22 to the print head 32. That is, the ink receiving tube 52 serves as an ink supply tube for supplying ink to the print head 32.

The positioning pin 53 is a positioning member being inserted and fitted into the positioning hole 6 so as to limit the movement of the ink cartridge 1 in directions along the front surface 2*c* (X axis and Z axis directions).

As shown in FIG. 5A, in an initial stage of the mounting operation, the ink cartridge 1 is inserted along the inside of a mounting guide 58. FIG. 5A is a cross-sectional view of the ink cartridge 1 being mounted on the joint unit 59. If the ink cartridge 1 is attached to the joint unit 59, the tube insertion port sealing film 18 is unsealed by the tip of the ink receiving tube 52 and the ink receiving tube 52 is inserted into the tube insertion port 8. Then, the positioning pin 53 is inserted into the positioning hole 6 and two position limiting surfaces 10 are sandwiched between two positioning walls (not shown), so that positional errors will be suppressed. In addition, since the positions of two portions near the bottom surface are limited by the two position limiting surfaces 10 and the position of one portion is limited by the positioning hole 6 located higher than the two position limiting surfaces 10, the movement of the ink cartridge 1 is generally limited. In particular, the movement of the ink cartridge 1 can be limited in directions along the front surface (XZ surface) 2*c* (X axis and Z axis directions) and in a θy direction.

Next, the atmosphere communication port sealing film 17 is unsealed by the tear pin 51 inserted into the through hole 27 and the tear pin 51 is inserted into the atmosphere communication port 7. Then, the ink receiving tube 52 is inserted into the seal member 19 provided inside the tube insertion path 22. This allows the ink storage chamber 11 to communicate with the ink receiving tube 52. FIG. 5B is a cross-sectional view of the ink cartridge when the mounting of the ink cartridge 1 on the joint unit 59 is completed.

(Supplying Ink to Print Head)

When ink stored in the ink storage chamber 11 is supplied to the print head 32, the ink moves to the tube insertion path 22. In the tube insertion port 8, the ink receiving tube 52 of the joint unit 59 at the ink jet printing apparatus body side is disposed, and the ink that has passed through the tube insertion path 22 flows into the ink receiving tube 52.

As the ink stored in the ink storage chamber 11 is consumed, the negative pressure in the ink storage chamber 11 gradually increases. To maintain the ink in the print head 32, the print head 32 is required to have the negative pressure at an appropriate level. Therefore, the negative pressure generation spring 13 urges the plate member 14 in a direction in which a volume of the ink storage chamber 11 expands inside the ink storage chamber 11. This generates a negative pressure inside the ink storage chamber 11, and the negative pressure is transmitted to the print head 32.

An appropriate meniscus is maintained at an ejection port inside the print head 32 by a balance between a capillary force in a thin path and the negative pressure in the ink storage container. This allows the ink to be maintained inside the print head 32.

As the ink stored in the print head 32 is ejected and the ink in the print head 32 decreases, the negative pressure in the print head 32 increases. This causes the ink to be supplied from the ink storage chamber 11 to the print head 32.

If the ink in the ink storage chamber 11 is supplied to the print head 32 and the negative pressure in the ink storage chamber 11 increases, the negative pressure in the ink storage chamber 11 may become excessively high. If the negative pressure in the ink storage chamber 11 becomes excessively high, ejection of ink from the print head 32 may be affected. To avoid this, as the negative pressure in the ink storage chamber 11 increases, air is filled into the ink storage chamber 11 depending on the level of the negative pressure in the ink storage chamber 11.

(Filling Air into Ink Storage Chamber)

Figure 6A:
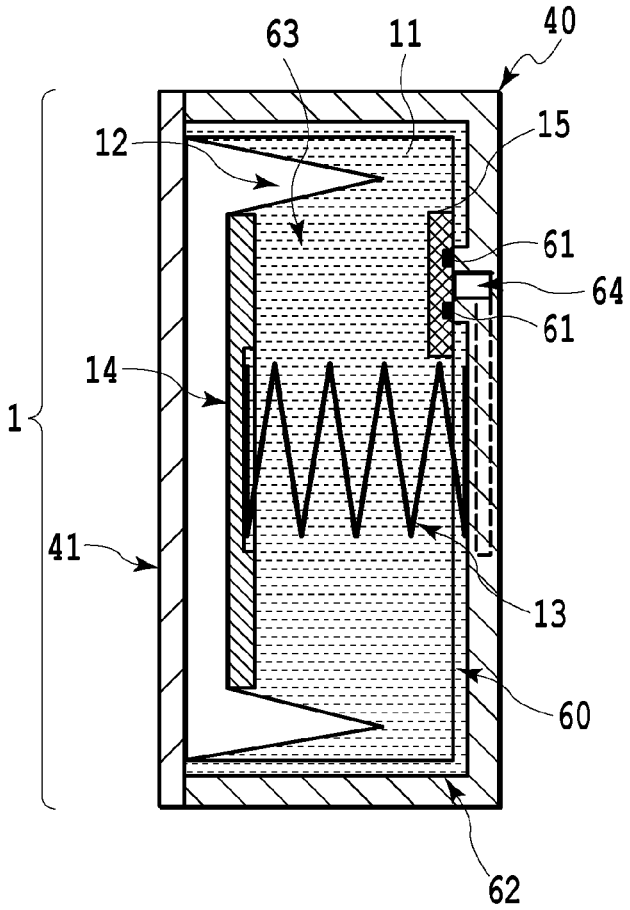
FIG. 6A is a cross-sectional view showing a state in which the ink cartridge of FIG. 2 is sufficiently filled with ink.
Figure 6B:
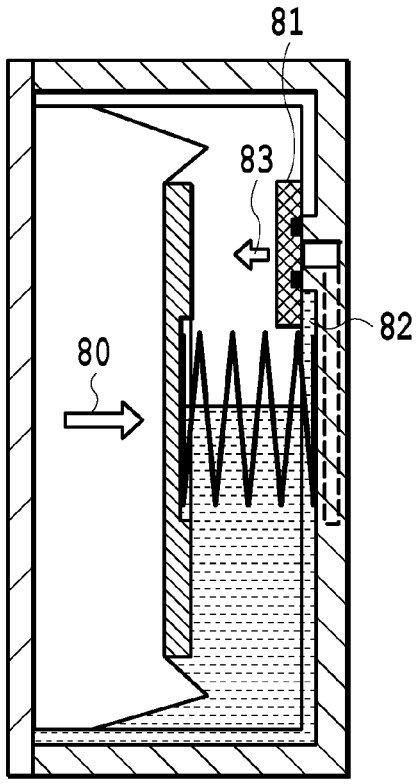
FIG. 6B is a cross-sectional view showing a state in which ink has been used in the ink cartridge of FIG. 2.
Figure 7C:
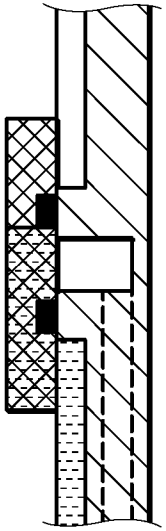
FIG. 7C is a cross-sectional view showing a state in which a meniscus is recovered after air is filled.
Figure 7B:
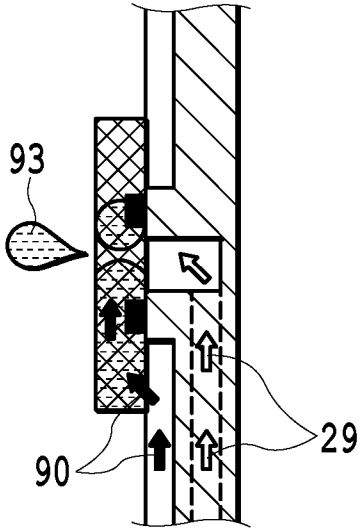
FIG. 7B is a cross-sectional view showing a state in which air is being filled through the filter.
Figure 7A:
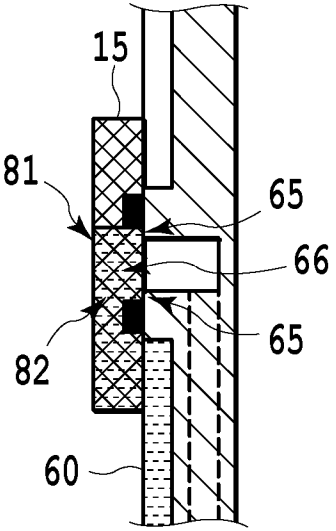
FIG. 7A is a cross-sectional view showing a filter of the ink cartridge of FIG. 2.

With reference to FIGS. 6A and 6B, a description will be given of a state of the ink cartridge 1 in which the negative pressure in the ink storage chamber 11 becomes high as ink is consumed, and accordingly air is filled into the ink storage chamber 11. FIG. 6A is a cross-sectional view of the ink cartridge 1 in an initial state in which ink in the ink storage chamber 11 is unused. FIG. 6B is a cross-sectional view of the ink cartridge 1 in the middle of use in which the ink in the ink storage chamber 11 is partly used. FIG. 7A is a cross-sectional view showing a portion around a connection at which the ink storage chamber 11 is connected to the atmosphere communication channel 16 via the filter 15 in the ink cartridge 1. FIG. 7B is a cross-sectional view of the portion around the connection at which the ink storage chamber 11 is connected to the atmosphere communication channel 16 in a state in which air is filled into the ink storage chamber 11 from the atmosphere communication channel 16 through the filter 15 in the ink cartridge 1. FIG. 7C is a cross-sectional view of the portion around the connection at which the ink storage chamber 11 is connected to the atmosphere communication channel 16 in a state in which filling of air into the ink storage chamber 11 from the atmosphere communication channel 16 is completed in the ink cartridge 1.

As described above, as ink is further supplied from the ink storage chamber 11 to the print head 32 and the ink in the ink storage chamber 11 decreases, the negative pressure in the ink storage chamber 11 increases. If the negative pressure in the ink storage chamber 11 reaches or exceeds a meniscus force of the filter 15, air is introduced from the atmosphere communication channel 16 through the filter 15 into the ink storage chamber 11.

As described above, the inside of the ink storage chamber 11 is connected to the atmosphere communication channel 16 via the filter 15, and the atmosphere communication channel 16 extends to the atmosphere communication port 7. As shown in FIG. 5B, when the ink cartridge 1 is attached to the joint unit 59, the tear pin 51 of the joint unit 59 is inserted into the atmosphere communication port 7. This allows the atmosphere communication channel 16 to be connected to the paths formed inside the tear pin 51 and the joint unit 59, whereby the inside of the ink storage chamber 11 communicates with the atmosphere. As the negative pressure in the ink storage chamber 11 increases, air from the outside is filled into the ink storage chamber 11 through the atmosphere communication channel 16, the path formed inside the tear pin 51, and the path formed inside the joint unit 59.

The filter 15 contacts both the atmosphere communication channel 16 for taking in outside air and the capillary groove 60 that may generate a desired capillary force. In the present embodiment, the filter 15 is an SUS mesh filter, but any filter, such as one made of resin and having the shape of a nonwoven type, may be used as long as it can be preferably used. The filter 15 is semi-welded into a housing member 111 via a welded rib 61.

As used herein, the term "semi-welding" means welding to a level that the filter 15 is welded into a contact surface 65 of the atmosphere communication channel opening in the present embodiment. Here, the contact surface 65 (see FIG. 7A) of the atmosphere communication channel opening in the ink storage chamber 11 is sealed by the filter 15. At this time, the contact surface 65 of the atmosphere communication channel opening is sealed by the filter 15 such that a capillary force in a space between the filter 15 and the contact surface 65 of the atmosphere communication channel opening is equal to or less than a capillary force in a smallest opening of the filter 15.

In the present embodiment, the capillary groove 60 is formed so as to supply ink in the ink storage chamber 11 to the filter 15 via the capillary groove 60. That is, the filter 15 is disposed so that ink is smoothly supplied in the ink path from the capillary groove 60 to the filter 15. The filter 15 is disposed so that when the ink supplied to the filter 15 reaches a meniscus formation portion 66 (see FIG. 7A) in the filter, ink is smoothly supplied to the meniscus formation portion 66 in the filter. In this manner, the filter 15 is disposed so that the ink supplied to the filter 15 via the capillary groove 60 is smoothly supplied to the meniscus formation portion 66 in the filter.

When the ink is ejected from the print head 32 and a negative pressure is generated in the print head 32, ink is supplied from the ink storage chamber 11 to the print head 32. At this time, the ink is supplied to the joint unit 59 from the tube insertion path 22 of the ink cartridge 1 via the ink receiving tube 52, and then to the print head 32.

If the ink is supplied to the print head 32, a volume of the ink in the ink storage chamber 11 decreases as shown in FIG. 6B. Accordingly, the plate member 14 causes the negative pressure generation spring 13 to contract while moving in a plate member displacement direction 80. Further, as the plate member 14 moves in the plate member displacement direction 80, an absolute value of the negative pressure in the ink storage chamber 11 also increases.

As the ink is further consumed, the absolute value of the negative pressure in the ink storage chamber 11 increases and if the negative pressure in the ink storage chamber 11 exceeds the absolute value of the capillary force of the filter 15, air is delivered to the ink storage chamber 11. At this time, if the negative pressure in the ink storage chamber 11 exceeds the absolute value of the capillary force of the filter 15, a difference between the pressure of the air in the atmosphere communication channel 16 and the pressure in the ink storage chamber 11 increases. Therefore, as shown in FIG. 7B, the air in the atmosphere communication channel 16 breaks the meniscus of the meniscus formation portion 66 in the filter and an air 93 is filled into the ink storage chamber 11 through the filter 15.

If the ink is further consumed in the ink storage chamber 11 from the state shown in FIG. 7A and the absolute value of the negative pressure in the ink storage chamber 11 exceeds the absolute value of the capillary force of the filter 15, air is filled into the ink storage chamber 11. At this time, as shown in FIG. 7B, the air 93 breaks the meniscus of ink in the meniscus formation portion 66 in the filter and the air 93 is filled into the ink storage chamber 11.

The air in the atmosphere communication channel 16 passes through an air discharge surface 81 of the filter 15 and is introduced into the ink storage chamber 11 (FIG. 7B). If the air is kept being filled into the ink storage chamber 11 while the ink is consumed, a liquid level of the ink lowers accordingly. Then, the filter 15 is exposed to a filled air 83 as the filter 15 is located higher than the liquid level of the ink. In a case where the liquid level is located below the filter 15, when air is filled into the ink storage chamber 11, every time the air passes through the filter 15, the ink present in the meniscus formation portion 66 in the filter is dispersed, and the ink is lost from the filter 15. However, ink is supplied and added to the meniscus formation portion 66 in the filter in a direction 90 to which the capillary groove 60 extends. Accordingly, after the meniscus is broken, ink is immediately supplied to the filter 15 in an amount corresponding to the ink removed from the filter 15. Then, a meniscus is promptly formed again in the filter 15 (FIGS. 7B and 7C).

In the present embodiment, the capillary groove 60 is located near a bottom surface 62 of the ink storage chamber and extends from the position below the liquid level of the ink to the position of the filter 15. The capillary groove 60 is formed so as to contact the filter 15. In the present embodiment, within the capillary groove 60, a capillary force is formed which is sufficient for the capillary groove 60 to raise the ink from the portion in which the ink is stored up to the position at which the filter 15 is disposed. In the present embodiment, the capillary groove 60 is formed to have a width in a range from 0.10 mm to 0.25 mm and a depth in a range from 0.10 mm to 0.25 mm. Note that the size of the capillary groove 60 is not limited to this. Depending on a surface tension of ink and a raise height, the capillary groove 60 may have any size as long as it can form a capillary force sufficient to raise the ink from the portion in which the ink is stored up to the position at which the filter 15 is disposed.

In addition, in the present embodiment, the plurality of capillary grooves 60 are provided inside the ink storage chamber 11 and extend radially and outwardly from the filter 15. FIGS. 8A to 8D are cross-sectional views showing the relationship between an area in which ink can exist and the capillary grooves 60. As shown in FIGS. 8A to 8D, even if the position of the ink cartridge 1 is changed, a portion of any one of the plurality of capillary grooves 60 is located in any portion of the area in which ink is stored.

Figure 8B:
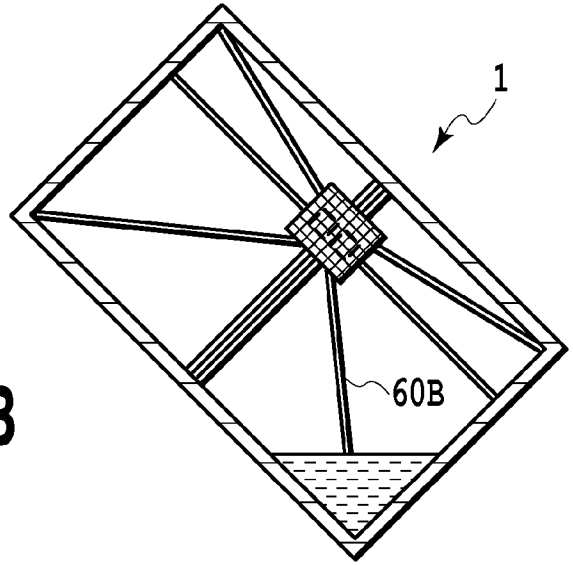
FIGS. 8B, 8C, and 8D are cross-sectional views showing the last remaining ink and the capillary grooves in different positions of the ink cartridge of FIG. 2.
Figure 8D:
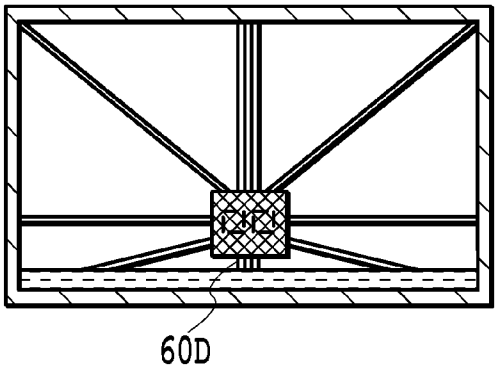
Figure 8A:
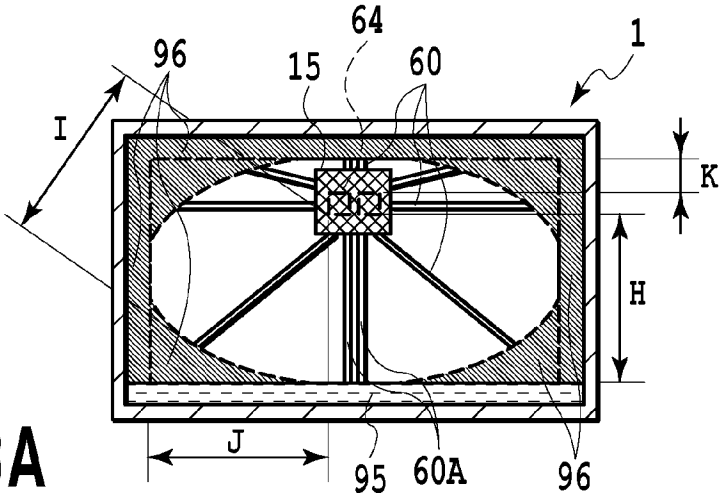
FIG. 8A is a view illustrating the relationship between the last remaining ink and capillary grooves in the ink cartridge of FIG. 2.

FIG. 8A is a cross-sectional view when the ink cartridge 1 is disposed in a normal position while being mounted on the ink jet printing apparatus. In the state shown in FIG. 8A, two capillary grooves 60A extending downwardly from the filter 15 extend to the portion in which ink is stored.

In the state shown in FIG. 8A, a lowest liquid level in the ink storage chamber 11 when the ink in the ink storage chamber 11 is used up is shown as a top surface of an ink remaining area 95. Ink remaining areas 95 and 96 indicate areas in which ink can exist when the ink in the ink storage chamber 11 is used up and left in a smallest amount in the ink storage chamber 11. The ink remaining area 95 indicates an area in which ink can exist when the ink is left in a smallest amount in the ink storage chamber 11 while the ink cartridge 1 is mounted on the joint unit 59 at the printing apparatus body side.

FIG. 8A shows the ink remaining areas 95 and 96, that is, areas in which ink can remain in a smallest amount. The ink remaining area 96 indicates an area in which ink can exist when the ink is left in a smallest amount in the ink storage chamber 11 while the ink cartridge 1 is mounted in a position other than when mounted on the joint unit 59 at the printing apparatus body side.

FIG. 8A shows the ink remaining areas 95 and 96 in various positions, more specifically, a total portion filled with the ink remaining areas 95 and 96 in all possible positions.

In FIG. 8A, a liquid level of the ink in the ink storage chamber 11 lowers to the ink remaining area 95 in the normal position, and ink does not exist near the filter 15. Even in such a case, the capillary grooves 60 allow the filter 15 to communicate with the ink present in the ink remaining area 95 in the normal position. Accordingly, the ink stored in the ink remaining area 95 in the normal position is raised to the filter 15 by the capillary force in the capillary grooves 60. This allows ink to be continuously supplied to the filter 15 to achieve prompt recovery of a meniscus.

If the capillary grooves 60 are not formed, the ink in the ink storage chamber 11 will not be raised up to the filter 15 and air may probably remain in the filter 15. If air remains in the filter 15, air may unexpectedly enter the ink storage chamber 11 through the filter 15. In this case, even if the negative pressure in the ink storage chamber 11 is not high enough, air may enter the ink storage chamber 11. If air enters the ink storage chamber 11 even if the negative pressure in the ink storage chamber 11 is not high enough, the negative pressure in the ink storage chamber 11 may not probably be maintained. Thus, there is possibility that a balance between the negative pressure in the ink storage chamber 11 and the negative pressure in the print head 32 cannot be maintained. Accordingly, the ink in the print head 32 and in the ink storage chamber 11 may not be maintained, and ink may drop from the ejection port of the print head 32.

In the present embodiment, the capillary grooves 60 extend downwardly to the position below the lowest liquid level at which the ink stored in the ink storage chamber 11 can exist in the ink cartridge 1 in a position when mounted on the ink jet printing apparatus. Accordingly, the capillary grooves 60 are located in an area below the lowest liquid level at which the ink stored in the ink storage chamber 11 can exist in the ink cartridge 1 in a position when mounted on the ink jet printing apparatus. Therefore, even if the ink in the ink storage chamber 11 is used up and the liquid level of the ink reaches the lowest liquid level at which the ink stored in the ink storage chamber 11 can exist while the ink cartridge 1 is mounted on the ink jet printing apparatus, the ink and the capillary grooves 60 contact each other. Even in such a case, therefore, ink can be supplied to the filter 15 by the capillary force by the capillary grooves 60.

Furthermore, in the present embodiment, in the ink cartridge 1 in all possible positions, the capillary grooves 60 extend downwardly to the position below the lowest liquid level at which the ink stored in the ink storage chamber 11 can exist. Accordingly, in all possible positions, the capillary grooves 60 are located in an area below the lowest liquid level at which the ink stored in the ink storage chamber 11 can exist. Irrespective of the positions of the ink cartridge 1, even if the ink in the ink storage chamber 11 is used up and the liquid level of the ink reaches the lowest liquid level at which the ink stored in the ink storage chamber 11 can exist, the ink and the capillary grooves 60 contact each other. Accordingly, even if the ink in the ink storage chamber 11 is used up, ink can be supplied to the filter 15 by the capillary force by the capillary grooves 60.

FIG. 8B is a cross-sectional view of the ink cartridge 1 after the position of the ink cartridge 1 as shown in FIG. 8A is changed. As shown in FIG. 8B, even if the position of the ink cartridge 1 is inclined, a capillary groove 60B extends downwardly to the position below the liquid level of a portion in which the ink remains finally after being used up. Accordingly, even if the position of the ink cartridge 1 is changed, the capillary groove 60 contacts with the ink, and ink can be supplied to the filter 15 by the capillary force by the capillary grooves 60.

Figure 8C:
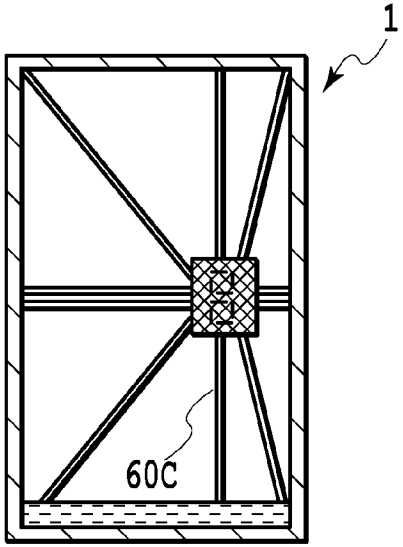

Furthermore, FIGS. 8C and 8D are cross-sectional views of the ink cartridge 1 after the position of the ink cartridge 1 is changed. In the state shown in FIG. 8C, the ink cartridge 1 further tilts as compared to the state shown in FIG. 8B, and the side surface of the ink cartridge 1 is located downward. In the state shown in FIG. 8D, the ink cartridge 1 tilts still further, and the top surface of the ink cartridge 1 in a mounted state is located downward. Also in the state shown in FIG. 8C, a capillary groove 60C extends downwardly to the position below the liquid level of a portion in which the ink remains finally after being used up. Accordingly, even if the position of the ink cartridge 1 is changed to the state shown in FIG. 8C, the capillary grooves 60 contact with the ink, and ink can be supplied to the filter 15 by the capillary force by the capillary grooves 60. In addition, also in the state shown in FIG. 8D, a capillary groove 60D extends downwardly to the position below the liquid level of a portion in which the ink remains finally after being used up. Accordingly, even if the position of the ink cartridge 1 is changed to the state shown in FIG. 8D, the capillary grooves 60 contact with the ink, and ink can be supplied to the filter 15 by the capillary force by the capillary grooves 60.

Since the capillary grooves 60 extend radially and outwardly from the filter 15, the capillary grooves 60 can contact with the stored ink when the ink cartridge 1 is in any position which is different from the position during normal use. Accordingly, ink can be supplied to the filter 15 irrespective of the position of the ink cartridge 1. Since ink can be reliably supplied to the filter 15 irrespective of the position of the ink cartridge 1, it is possible to prevent the filter 15 from being exposed to the air. Accordingly, even if the position of the ink cartridge 1 is changed, it is possible to prevent air from remaining in the filter 15, thereby certainly preventing air from remaining in the filter 15.

Further, in the present embodiment, supply of ink to the filter 15 via the capillary grooves 60 is performed toward a contact surface of the filter 15 with the atmosphere communication channel 16. Therefore, supply of ink to the filter 15 by the capillary grooves 60 is performed in a side opposite to a side in which filling of air is performed. Since filling of air into the ink storage chamber 11 is performed on the air discharge surface 81 of the filter 15, it is possible to avoid blocking of the supply of ink to the filter 15. Therefore, even if air is continuously filled into the ink storage chamber 11 by increasing an ink flow to the print head 32 due to an increase in ejection of ink from the print head 32, ink can be sufficiently supplied to the filter 15. Since ink is reliably supplied to the filter 15, it is possible to promptly recover a meniscus when the air is filled into the ink storage chamber 11. Accordingly, it is possible to prevent the negative pressure to be lost due to a delay in the recovery of the meniscus when the air is filled into the ink storage chamber 11.

Regarding the height of the atmosphere communication channel 16, the atmosphere communication channel 16 is located so as to ensure the supply of ink to the filter 15 irrespective of the position of the ink cartridge 1 which is different from the position during normal use.

As shown in FIG. 8A, a distance between the atmosphere communication channel 16 and the ink remaining area 95 in the normal position of the ink cartridge 1 when mounted on the ink jet printing apparatus is represented by H. Further, distances between the atmosphere communication channel 16 and the ink remaining area 96 in other positions are represented by I, J, and K. At this time, in the present embodiment, the capillary grooves 60 are formed to satisfy the following relationships: H>I, H>J, and H>K. That is, the atmosphere communication channel 16 is formed and the capillary grooves 60 are formed such that the distance H between the atmosphere communication channel 16 and the ink remaining area 95 in the normal position is greater than the distances I, H, and K between the atmosphere communication channel 16 and the ink remaining area 96 in other positions.

As described above, in the normal position, the capillary grooves 60 are formed such that the capillary grooves 60 certainly contact with the stored ink. Further, the capillary grooves 60 are formed such that, in any other positions, the capillary groove(s) 60 certainly contact(s) with the area in which the ink is stored. Since the capillary grooves 60 are formed in this manner, ink is reliably supplied to the filter 15 irrespective of the position of the ink cartridge 1. Accordingly, it is possible to prevent the filter 15 from being exposed to the air and to prevent air from entering the ink storage chamber 11 through the filter 15.

In the present embodiment, an absolute value of the capillary force of the filter 15 during use of ink is about 160 mmAq. A distance from the bottom surface of the ink cartridge 1 to the atmosphere communication channel 16 is in a range between 16 mm to 20 mm. In this manner, in the present embodiment, since the capillary grooves 60 are provided to supply ink to the filter 15, ink can be reliably supplied to the filter 15. Therefore, it is possible to certainly prevent air from remaining in the filter 15. Since it is possible to prevent air from remaining in the filter 15, it is possible to prevent air from unexpectedly being filled into the ink storage chamber 11 when the negative pressure is not so high. Since it is possible to prevent air from being filled into the ink storage chamber 11 when the negative pressure is not so high, it is possible to keep the negative pressure in the ink storage chamber 11. This allows the negative pressure in the ink storage chamber 11 and the negative pressure in the print head 32 to be kept in balance, and ink can be reliably maintained in the ink storage chamber 11 and the print head 32. Furthermore, since it is possible to prevent the ejection of ink from the print head 32 to be affected by the loss of the negative pressure in the ink storage chamber 11, it is possible to keep the ejection amount of ink from the print head 32 in a desired amount and to stably perform ink ejection. Accordingly, a quality of a print image obtained by printing can be kept high.

Second Embodiment

Next, a description will be given of an ink cartridge according to a second embodiment of the present invention. The same reference signs are added to the drawings for portions having the same configuration as the first embodiment, and their explanations will be omitted. Only different portions will be described.

Figure 9A:
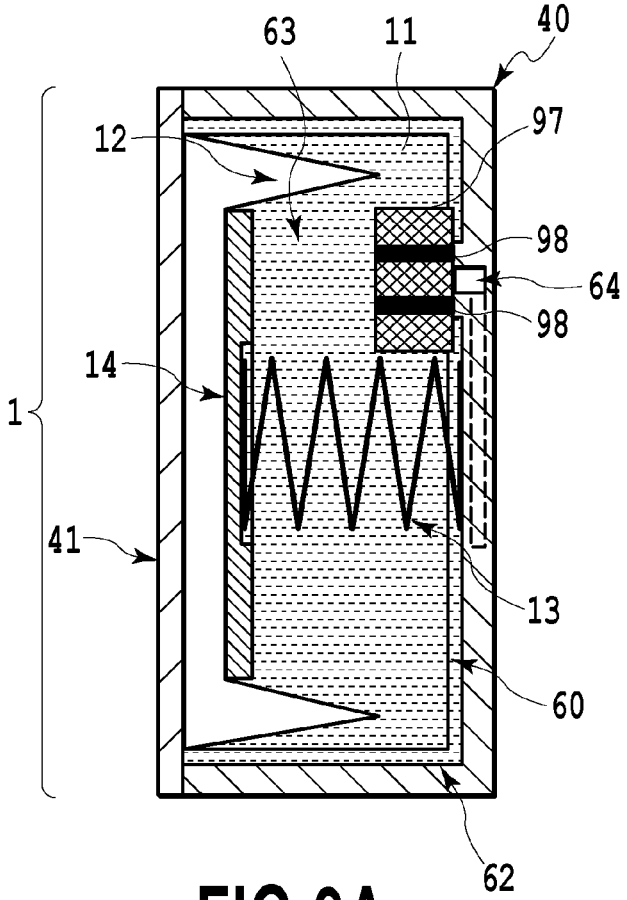
FIG. 9A is a cross-sectional view of an ink cartridge according to a second embodiment of the present invention when ink is sufficiently stored.
Figure 9B:
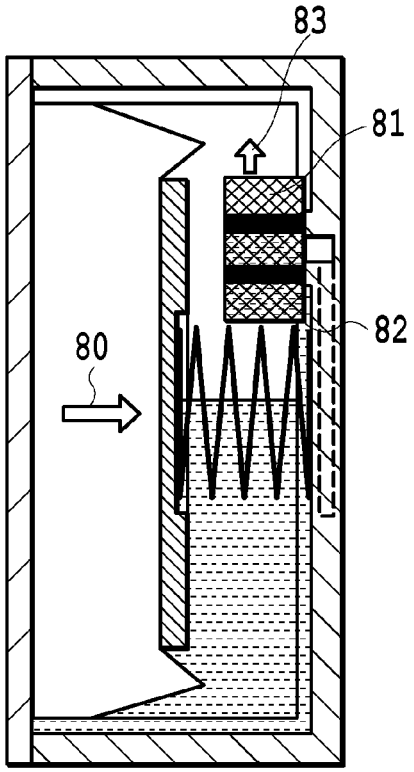
FIG. 9B is a cross-sectional view of the ink cartridge when ink is consumed.
Figure 9C:
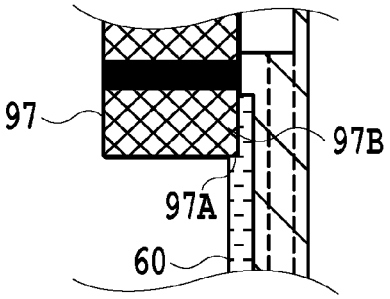
FIG. 9C is a cross-sectional view of a portion around an absorption body.

FIGS. 9A to 9C are cross-sectional views of an ink cartridge according to a second embodiment. FIG. 9A is a cross-sectional view of the ink cartridge according to the second embodiment when ink is sufficiently stored. FIG. 9B is a cross-sectional view of the ink cartridge when ink is used.

In the first embodiment, the filter 15 formed by an SUS mesh filter is disposed at a connection between the atmosphere communication channel 16 and the ink storage chamber 11. Meanwhile, in the second embodiment, an absorption body 97 made of polyurethane foam, a PP fiber assembly, a melamine resin, an olefin resin sintered compact, or the like is disposed at a connection between an atmosphere communication channel 16 and an ink storage chamber 11. Also the absorption body 97 can raise stored ink to the connection between the ink storage chamber 11 and the atmosphere communication channel 16 to keep a negative pressure in the ink storage chamber 11 at a predetermined level.

The absorption body 97 of the present embodiment is formed to have a thickness greater than that of the filter 15 of the first embodiment. The absorption body 97 is attached to a wall surface forming the ink storage chamber 11 by a plurality of swaging pins 98. The absorption body 97 has the same function as the filter 15 of the first embodiment, but the absorption body 97 can keep a larger amount of ink as compared to the filter 15.

Furthermore, the absorption body 97 of the second embodiment contacts with capillary grooves 60 on a greater surface as compared to the filter 15 of the first embodiment. FIG. 9C is a cross-sectional view of the ink cartridge, particularly an enlarged view of a portion around the absorption body 97.

In the present embodiment, as shown in FIG. 9C, part of a bottom surface 97A of the absorption body 97 and part of a back surface 97B of the absorption body 97 contact with the capillary grooves 60. Since the absorption body 97 contacts with the capillary grooves 60 on more portions, ink that has been raised via the capillary groove 60 can be reliably supplied by the absorption body 97. Since ink can be supplied to the absorption body 97 more reliably, it is possible to prevent air from remaining in the absorption body 97 more reliably. Further, since more prompt recovery of a meniscus can be achieved, it is possible to have an ink cartridge having a greater flow rate of ink supplied from the ink storage chamber 11 to a print head 32.

In the above embodiment, the capillary groove 60 allows the ink to be raised up and supplied to the filter 15 or the absorption body 97. However, the present invention is not limited to this. Other configurations may be used to cause the ink to be raised up and supplied to the filter 15 or the absorption body 97 as long as the stored ink can be raised up to the filter 15 or the absorption body 97. For example, instead of the capillary groove 60, a rod-like porous body (absorption body, etc.) may be used. Even when the rod-like porous body is used, ink can be raised up to the filter 15 or the absorption body 97 by a capillary force.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-132854, filed Jun. 27, 2014, which is hereby incorporated by reference wherein in its entirety.

What is claimed is:

1. A liquid storage container comprising:

a liquid storage chamber storing therein a liquid;

a communication portion formed in the liquid storage chamber and allowing the liquid storage chamber to communicate with the outside;

a negative pressure generation unit configured to generate a negative pressure in the liquid storage chamber;

a limiting member attached to the communication portion and allowing air to pass from the outside to the inside of the liquid storage chamber depending on the negative pressure in the liquid storage chamber; and a liquid supply unit configured to supply a liquid to the limiting member from a portion in which the liquid is stored in the liquid storage chamber, wherein the limiting member contacts with the liquid supply unit inside the liquid storage chamber.

2. The liquid storage container according to claim 1, wherein the liquid supply unit is a groove configured to supply a liquid to the limiting member by a capillary force.

3. The liquid storage container according to claim 1, wherein the liquid supply unit is a porous body configured to supply a liquid to the limiting member by a capillary force.

4. The liquid storage container according to claim 1, the liquid storage container being capable of being mounted on a liquid ejection apparatus configured to eject a liquid, wherein the liquid supply unit is formed below a lowest possible liquid level of a liquid stored in the liquid storage chamber in a position when the liquid storage container is mounted on the liquid ejection apparatus.

5. The liquid storage container according to claim 4, wherein the liquid supply unit is formed below a lowest possible liquid level of a liquid stored in the liquid storage chamber in all possible positions.

6. The liquid storage container according to claim 1, wherein a plurality of the liquid supply units are provided inside the liquid storage chamber, the plurality of liquid supply units being provided to extend radially from the limiting member.

7. The liquid storage container according to claim 1, wherein the limiting member prevents air from passing from the inside of the liquid storage chamber to the outside.

8. The liquid storage container according to claim 1, wherein the negative pressure generation unit has a flexible member attached to the liquid storage chamber and an urging unit configured to urge the flexible member in a direction in which a volume of the liquid storage chamber expands.

9. The liquid storage container according to claim 1, wherein a surface of the limiting member, which is a surface except a reverse surface to a surface adjoining to the communication portion, contacts with the liquid supply unit.

10. The liquid storage container according to claim 1, wherein a surface of the limiting member, which is a surface adjoining to the communication portion, contacts with the liquid supply unit.

11. The liquid storage container according to claim 1, wherein the limiting member contacts with the communication portion.

12. A liquid ejection apparatus capable of being mounted on the liquid storage container, the liquid storage container comprising:

a liquid storage chamber storing therein a liquid;

a communication portion formed in the liquid storage chamber and allowing the liquid storage chamber to communicate with the outside;

a negative pressure generation unit configured to generate a negative pressure in the liquid storage chamber;

a limiting member attached to the communication portion and allowing air to pass from the outside to the inside of the liquid storage chamber depending on the negative pressure in the liquid storage chamber; and a liquid supply unit configured to supply a liquid to the limiting member from a portion in which the liquid is stored in the liquid storage chamber, wherein the limiting member contacts with the liquid supply unit inside the liquid storage chamber, and wherein the liquid ejection apparatus is capable of ejecting a liquid stored in the liquid storage chamber in the liquid storage container.

13. The liquid ejection apparatus according to claim 12, wherein a surface of the limiting member, which is a surface except a reverse surface to a surface adjoining to the communication portion, contacts with the liquid supply unit.

14. The liquid ejection apparatus according to claim 12, wherein a surface of the limiting member, which is a surface adjoining to the communication portion, contacts with the liquid supply unit.

15. The liquid ejection apparatus according to claim 12, wherein the limiting member contacts with the communication portion.

* * * * *